US006012294A

United States Patent [19]

Utsumi

[11] Patent Number: 6,012,294

[45] Date of Patent: Jan. 11, 2000

[54] AIR CONDITIONER CONTROL METHOD AND APPARATUS OF THE SAME

[75] Inventor: Takashi Utsumi, Kawasaki, Japan

[73] Assignee: Fujitsu General Limited, Kawasaki, Japan

[21] Appl. No.: 09/210,476

[22] Filed: Dec. 14, 1998

[30] Foreign Application Priority Data

Dec. 18, 1997 [JP] Japan ..... 9-364588

[51] Int. Cl.[7] ..... F25B 47/00

[52] U.S. Cl. ..... 62/81; 62/156; 62/278

[58] Field of Search ..... 62/156, 151, 155, 62/234, 81, 277, 278, 160, 324.5, 196.4

[56] References Cited

U.S. PATENT DOCUMENTS

| | | | |
|---|---|---|---|
| 4,313,313 | 2/1982 | Chrostowski et al. | 62/278 |
| 4,432,211 | 2/1984 | Oishi et al. | 62/156 X |
| 4,530,217 | 7/1985 | Alluto et al. | 62/156 |
| 4,625,524 | 12/1986 | Kimura et al. | 62/278 |

*Primary Examiner*—Harry B. Tanner
*Attorney, Agent, or Firm*—Kanesaka & Takeuchi

[57] ABSTRACT

In a heat pump type air conditioner, a refrigerant ejection port of a compressor in a refrigerating cycle thereof is connected to a refrigerant inflow port of an outdoor heat exchanger via a bypass pipe with a shut-off valve, and temperature sensors detect the temperatures of the refrigerant inflow and runoff port sides of an outdoor heat exchanger. In a heating operation mode, when the temperature of the refrigerant inflow or runoff port side reaches a certain value or lower that requires defrosting, the shut-off valve of the bypass pipe is "opened" to start defrosting using the hot gas bypass defrosting method. The temperature of the refrigerant runoff port side is detected every specified time so that if the temperature change rate is less than or equal to a predetermined value, the shut-off valve is "closed" and the four-way valve in the refrigerating cycle is switched to the cooling operation mode side in order to switch to the reverse defrosting method that allows a hot gas to flow in the reverse direction from said compressor to said outdoor heat exchanger, thereby enabling the outdoor heat exchanger to be defrosted promptly.

5 Claims, 4 Drawing Sheets

AIR CONDITIONER CONTROL METHOD AND APPARATUS OF THE SAME

TECHNICAL FIELD

The present invention relates to a heat pump type air conditioner, and in particular, to a defrosting control technique for appropriately defrosting an outdoor heat exchanger during a heating operation depending on the frosting condition of the heat exchanger.

BACKGROUND ART

A heat pump type air conditioner comprises a refrigerating cycle including a compressor 1, a four-way valve 2, an indoor heat exchanger 3, an expansion valve (an electronic expansion valve) 5, and an outdoor heat exchanger 4, as schematically shown in FIG. 5.

In addition, to defrost the outdoor heat exchanger 4 during a heating operation, a bypass pipe 7 having a solenoid-operated valve 6 is provided between a refrigerant ejection port of the compressor 1 and a refrigerant inflow port of the outdoor heat exchanger 4. The solenoid-operated valve 6 is normally "closed."

During a heating operation, the refrigerant is circulated from the compressor 1 through the four-way valve 2, the indoor heat exchanger 3, electronic expansion valve 5, outdoor heat exchanger 4, and four-way valve 2 to the compressor 1, as shown by the continuous-line arrow in FIG. 5.

During this heating operation, the indoor machine side having the indoor heat exchanger 3 rotationally controls an indoor fan to blow into the room, warm air obtained by a heat exchanging operation executed by the indoor heat exchanger 3, and transfers to the outdoor machine side an operational-frequency code corresponding to the difference between the indoor temperature and a set temperature on a remote controller.

The outdoor machine side having the outdoor heat exchanger 4 operates the compressor 1 according to the operational-frequency code to circulate the refrigerant. This operation controls the room temperature to the set temperature by a remote controller.

Specifically, the indoor and outdoor machines each include a control section consisting of a microcomputer. The control section on the indoor machine side controls the indoor fan according to an instruction from the remote controller and transfers to the control section on the outdoor machine side, data such as the operational frequency corresponding to the difference between the room temperature and the set value. The control section on the outdoor machine side controls the compressor and the outdoor fan according to the data.

If the outdoor heat exchanger 4 is frosted, its heat exchanging efficiency decreases to degrade the performance of the air conditioner, so the outdoor heat exchanger 4 must be defrosted.

The defrosting method includes a hot gas bypass defrosting method and a reverse defrosting method. Either of these methods is conventionally used.

In the hot gas bypass defrosting method, when the temperature of the outdoor heat exchanger 4 decreases down to a defrosting start value (for example, −10° C.; see FIG. 6), the control section determines that the heat exchanger is frosted to open the solenoid-operated valve 6 in order to supply part of a refrigerant (a hot gas) ejected from the compressor 1 to the outdoor heat exchanger 4 via the bypass pipe 7 (see the continuous-line arrow in FIG. 5).

Thus, the outdoor heat exchanger 4 is defrosted. When the temperature of the outdoor heat exchanger 4 reaches a defrost cancel value, the solenoid-operated valve 6 is closed to return to the normal heating operation.

The hot gas bypass defrosting method allows the refrigerant circulating path for the heating operation to be used during the refrigerating cycle without change and enables the outdoor heat exchanger 4 to be defrosted while continuing the heating operation.

In the reverse defrosting method, when the temperature of the outdoor heat exchanger 4 decreases down to a defrosting start value, the four-way valve 2 is switched to reverse the flow of the refrigerant (see the chain line arrow in FIG. 5) in order to feed a hot gas into the outdoor heat exchanger 4. During this defrosting, the indoor fan on the indoor machine side is stopped. When the temperature of the outdoor heat exchanger 4 reaches the defrost cancel value, the four-way valve 2 is switched again to return the flow of the refrigerant to the original direction.

Thus, the reverse defrosting method enables the outdoor heat exchanger 4 to be defrosted in a short time and does not require the bypass pipe 7 or solenoid-operated valve 6, thereby precluding the costs of the air conditioner from increasing.

Both methods, however, have both advantages and disadvantages. The reverse defrosting method enables defrosting to be executed in a relatively short time despite a large amount of frost, but is disadvantageous in that the temporary interruption of the heating operation causes the room temperature to decrease during this interruption.

On the contrary, the hot gas bypass defrosting method only reduces the amount of refrigerant circulated to the indoor heat exchanger 3, so it does not significantly reduce the room temperature. This method, however, is disadvantageous in that since the temperature of the outdoor heat exchanger 4 increases slowly as shown in the temperature graph of the outdoor heat exchanger 4 in FIG. 6, a large amount of time is required for the defrost cancel temperature to be reached.

SUMMARY OF THE INVENTION

The present invention is provided to solve these problems of each defrostingmethod, and its object is to allow an appropriate defrosting method to be selected depending on the frosting condition of the outdoor heat exchanger to minimize the decrease in room temperature in order to enable defrosting to be executed in a short time.

According to this invention, this object is achieved by an air conditioner having a refrigerating cycle including a compressor, four-way valve, an indoor heat exchanger, an expansion valve, and an outdoor heat exchanger to switch the four-way valve to reversibly switch the refrigerating cycle between a heating and a cooling operation modes, the air conditioner including a hot gas bypass passage with a shut-off valve between a refrigerant ejection port of the compressor and a refrigerant inflow port of the outdoor heat exchanger, wherein temperature sensors are provided on both refrigerant inflow and runoff port sides of the outdoor heat exchanger so that when, in the heating operation mode, the temperature of the refrigerant inflow or runoff port side reaches a predetermined value (a defrost start temperature) or lower that requires defrosting, the shut-off valve is "opened" to start defrosting using the hot gas bypass defrosting method, and wherein the temperature of the refrigerant runoff port side of the outdoor heat exchanger is detected every specified time so that if the temperature change rate is less than or equal to a predetermined value, the shut-off valve is "closed" and the four-way valve is switched to the cooling operation mode side in order to switch to the reverse defrosting method that allows a hot gas to flow in the reverse direction from the compressor to the outdoor heat exchanger.

According to this invention, during defrosting using the hot gas bypass defrosting method, the expansion valve is preferably contracted in a predetermined manner to reduce the amount of refrigerant passing through the valve, whereas during defrosting using the reverse defrosting method, the expansion valve is preferably returned to its original state.

According to this invention, if during defrosting using the reverse defrosting method, the temperature change rate reaches a predetermined value or higher, the shut-off valve may be "opened" and the four-way valve may be switched to the heating operation mode to return to the hot gas bypass defrosting method.

The refrigerating cycle normally has a suction sensor section. Since, during a heating operation, the suction sensor section is located close to the refrigerant runoff port of the outdoor heat exchanger, it can substitute for the second temperature sensor provided on the refrigerant runoff port side of the outdoor heat exchanger. This phase is also included in this invention.

BRIEF DESCRIPTION OF DRAWINGS

An embodiment of this invention is described below with reference to the accompanying drawings. The drawings are described below.

DETAILED DESCRIPTION

If an outdoor heat exchanger is frosted, this invention first uses the hot gas bypass defrostingmethod for defrosting while detecting the temperature change rate of the outdoor heat exchanger to determine the frosting condition based on this rate.

That is, if the temperature change rate is small, this invention determines that the heat exchanger is heavily frosted (a bad condition) to switch from the hot gas bypass defrosting method to the reverse defrosting method. If the temperature change rate is large, this invention determines that the heat exchanger is slightly frosted to continue the hot gas bypass defrosting method without change. In this manner, either the hot gas bypass defrosting method or reverse defrosting method is selected depending on the frosting condition.

Figure 1:
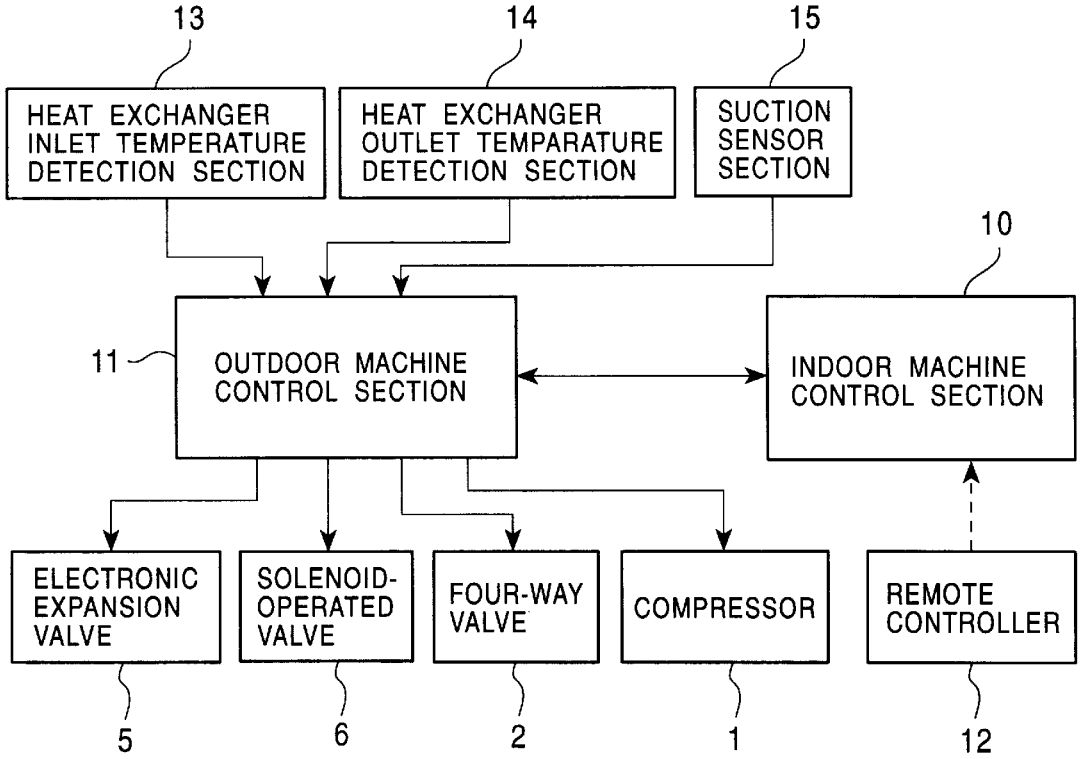
FIG. 1 is a schematic block diagram showing a control apparatus for an air conditioner according to this invention.

Thus, the air conditioner according to this invention includes an indoor machine control section 10 and an outdoor machine control section 11, as shown in FIG. 1.

Figure 2:
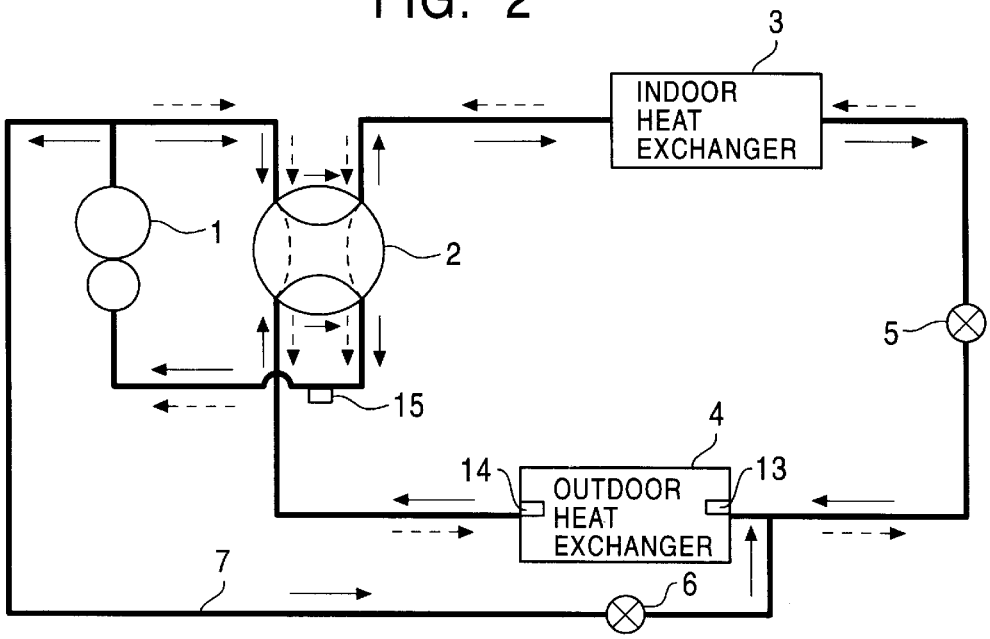
FIG. 2 is an image drawing showing a refrigerating cycle of the air conditioner.
Figure 5:
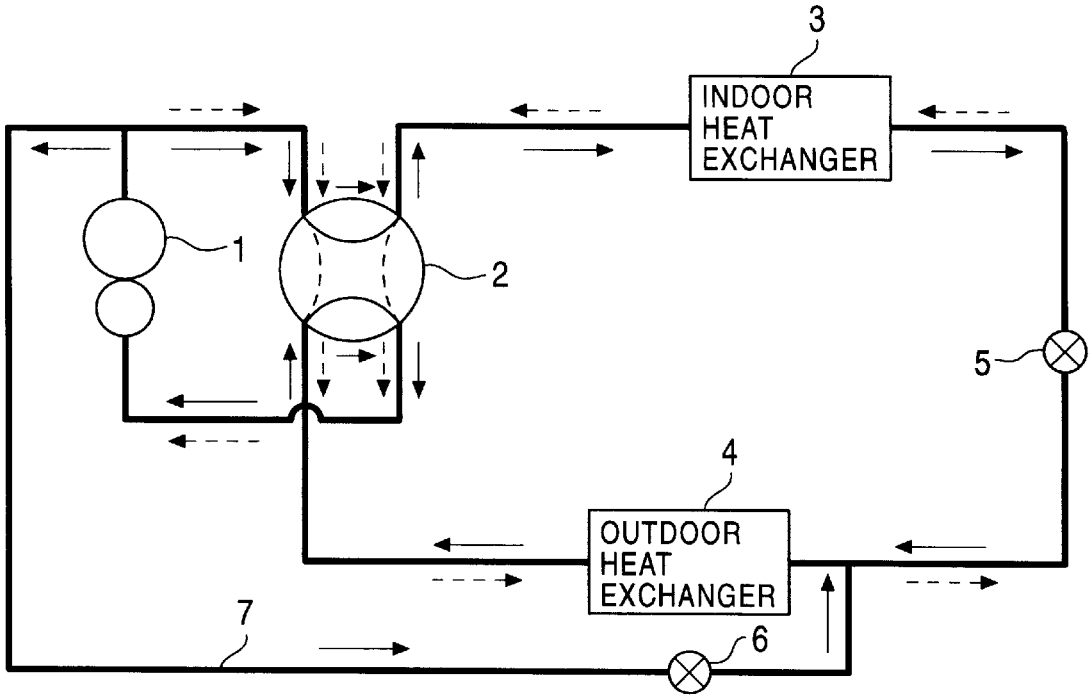
FIG. 5 is a schematic block diagram showing a refrigerating cycle of a conventional air conditioner.

FIG. 2 shows a refrigerating cycle of this air conditioner, but its basic configuration is the same as in the refrigerating cycle in FIG. 5. That is, the refrigerating cycle of this air conditioner includes a bypass pipe 7 that connects together a refrigerant ejection port of a compressor 1 and a refrigerant inflow port of an outdoor heat exchanger 4, and a solenoid-operated valve 6 that opens and closes the bypass pipe 7.

The indoor machine control section 10 and the outdoor machine control section 11 correspond to the control sections on the indoor and outdoor machine sides of the conventional example described above.

That is, the indoor machine control section 10 drives .an indoor fan according to a remote control signal from a remote controller 12 while detecting the room temperature to compare it with a set temperature set by the remote controller 12 and according to the results of the comparison, transferring instruction data such as an operational-frequency code for the compressor 1 to the outdoor machine control section 11. The outdoor machine control section 11 drives the compressor 1 and an outdoor fan according to this instruction data.

The outdoor machine side has a temperature sensor 13 that detects a heat exchanger inlet temperature Tni on the refrigerant inflow port side of the outdoor heat exchanger 4, and a temperature sensor 14 that detects a heat exchanger outlet temperature Tno on the refrigerant runoff port side of the outdoor heat exchanger 4.

During a heating operation, based on the temperature detection signals from the temperature sensors 13 and 14, the outdoor machine control section 11 determines whether the outdoor heat exchanger 4 has been frosted, and if so, opens thesolenoid-operated valve 6 to start defrosting using the hot gas bypass defrosting method. The outdoor heat exchanger 4 also obtains the heat exchanger outlet temperature Tno every specified time to calculate the temperature change rate $\Delta Tn$ and depending on the temperature change rate $\Delta Tn$, determines whether to continue the hot gas bypass defrosting method or to switch to the reverse defrosting method.

Figure 3:
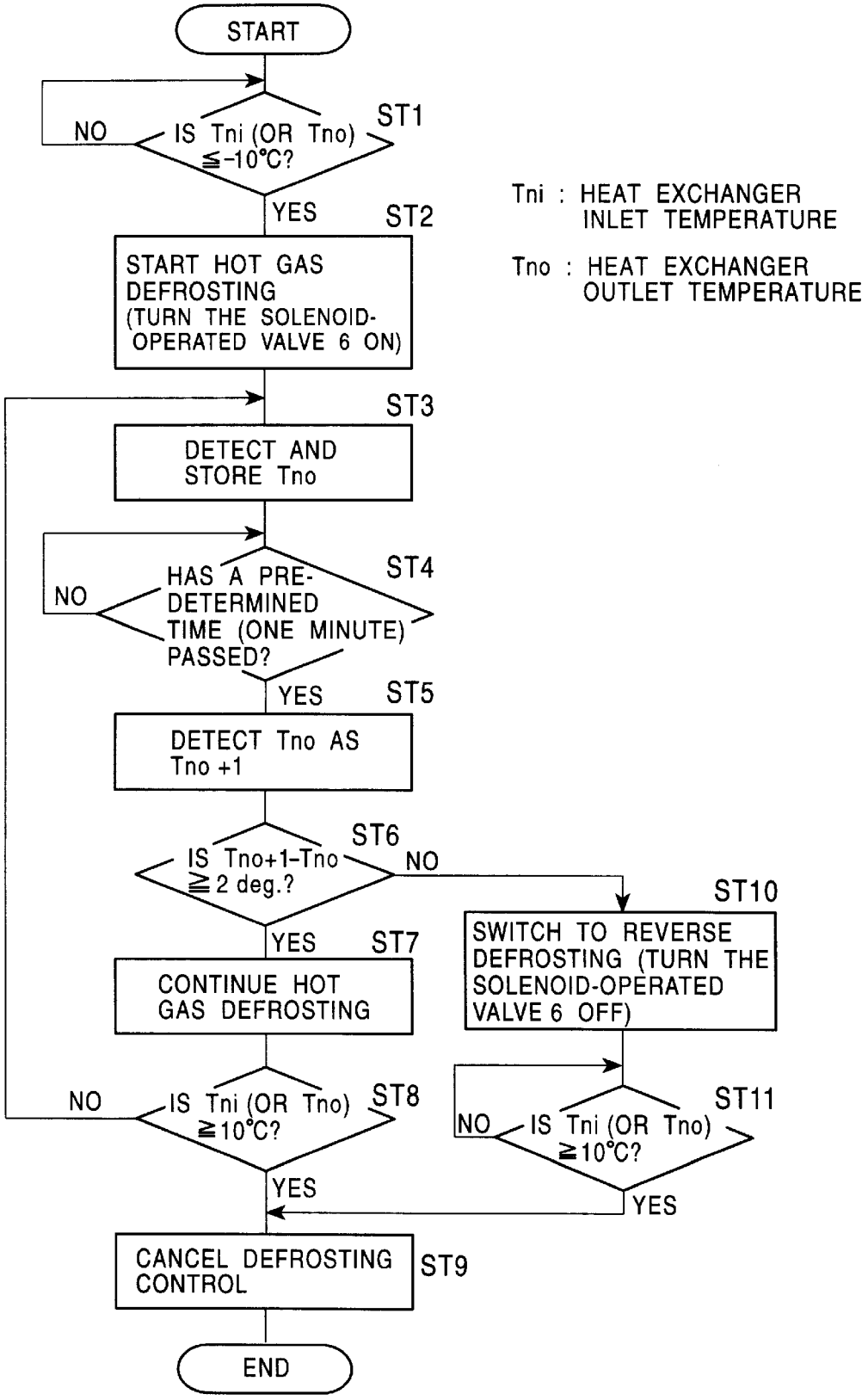
FIG. 3 is a flowchart describing a defrosting apparatus according to this invention.

Next, the selection process in this defrosting method is described with reference to the flowchart in FIG. 3 and the temperature graph of the outdoor heat exchanger in FIG. 4.

First, the remote controller 12 selects the heating operation, and once the room temperature is set, the indoor machine control section 10 transfers to the outdoor machine control section 11 a signal required to adjust the room temperature (instruction data such as an operational-frequency code).

Based on this signal, the outdoor machine control section 11 switches the four-way valve 2 to a heating side, and drives the compressor 1 up to a predetermined rate while setting an electronic expansion valve 5 at a predetermined degree of opening to activate the refrigerating cycle of a heating operation.

When the heating operation is started in this manner, the outdoor machine control section 11 monitors the temperature detection signal from the temperature sensors 13 and 14 at step ST1 to determine whether or not the heat exchanger inlet temperature Tni is lower than or equal to a defrost start temperature (for example, −10° C.) according to this embodiment. Instead of the heat exchanger inlet temperature Tni, the heat exchanger outlet temperature Tno may be determined to be lower than or equal to the defrost start temperature value.

If the temperature of the outdoor heat exchanger 4 decreases and the heat exchanger inlet temperature Tni reaches −10° C. or lower (see FIG. 3), the outdoor machine control section 11 determines that the outdoor heat exchanger 4 is frosted to proceed to step ST2 in order to start hot gas bypass defrosting. That is, the control section 11 opens the solenoid-operated valve 6, which has been closed, to feed part of a refrigerant (a hot gas) ejected from the compressor 1 back to the outdoor heat exchanger 4 via the bypass pipe 7 in order to heat the outdoor heat exchanger 4.

Subsequently, step ST3 detects the heat exchanger outlet temperature Tno to temporarily store it. Step ST4 waits for a predetermined time (in this embodiment, one minute), and step ST5 detects the heat exchanger outlet temperature Tno again as Tno+1 to calculate the temperature change rate ΔTn (=Tno+1−Tno) from Tno and Tno+1.

Step ST6 determines whether or not the temperature change rate ΔTn is higher than or equal to a predetermined value (in this embodiment 2° C.).

Figure 4:
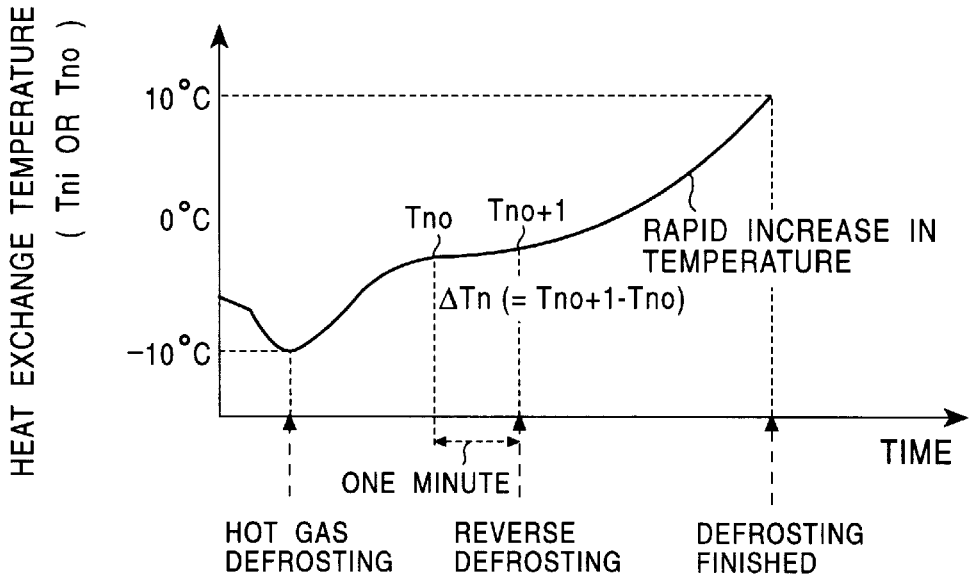
FIG. 4 is a graph showing changes in the temperature of an outdoor heat exchanger during defrosting according to this invention.

As shown in FIG. 4, immediately after the start of hot gas bypass defrosting, the refrigerant from the compressor 1 substantially increases the temperature of the heat exchanger up to a certain value, and this high temperature rate ΔTn causes step ST6 to proceed to step ST7 to continue hot gas bypass defrosting.

Subsequently, step ST8 determines whether or not the heat exchanger inlet temperature Tni (or the heat exchanger outlet temperature Tno) is higher than or equal to a defrost cancel temperature value (in this embodiment, +10° C.), and if not, returns to step ST3. This routine is repeated until the heat exchanger inlet temperature Tni reaches the defrost cancel temperature value.

In this manner, if the temperature change rate ΔTn of the outdoor heat exchanger 4 measured every minute is high, that is, 2° C. or more, the process determines that defrosting is being appropriately carried out to continue hot gas bypass defrosting, and when the heat exchanger inlet temperature Tni reaches 10° C., proceeds to step ST9 to close the solenoid-operated valve 6 in order to cancel hot gas bypass defrosting.

Figure 6:
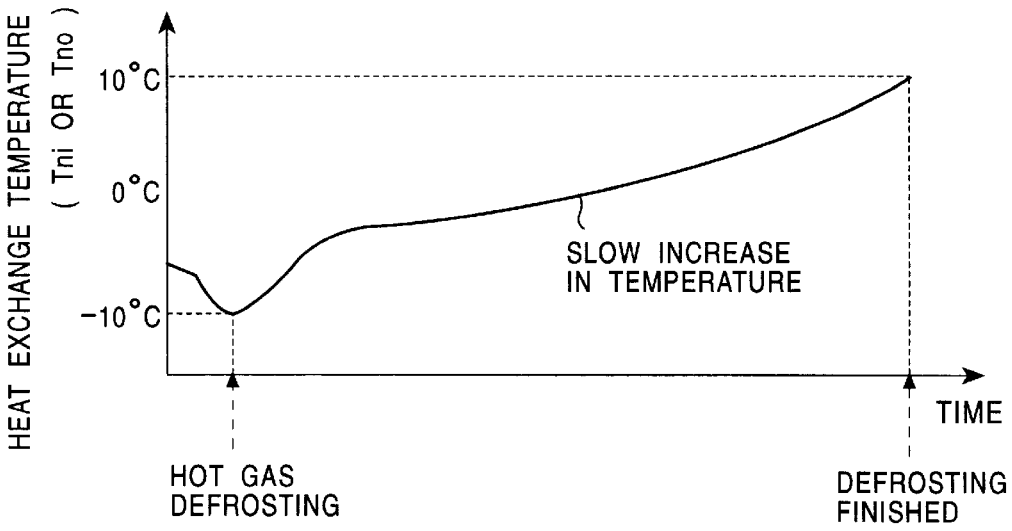
FIG. 6 is a graph showing changes in the temperature of the outdoor heat exchanger during defrosting using the hot gas bypass defrosting method.

On the contrary, if the outdoor heat exchanger 4 is heavily frosted and if hot gas bypass defrosting is being executed, the temperature change rate ΔTn decreases once the heat exchanger temperature has increased up to a certain value. If the temperature change rate ΔTn decreases below 2° C., defrosting requires a large amount of time as described in the conventional example (see FIG. 6).

Thus, according to this invention, if the temperature change rate ΔTn of the outdoor heat exchanger 4 is 2° C. or lower after hot gas bypass defrosting has been started, the process passes from step ST6 to step ST10 to switch the hot gas by pass defrosting method to the reverse defrosting method (see FIG. 4).

That is, the solenoid-operated valve 6 is closed and the four-way valve 2 is switched to the cooling operation side to reverse the flow of the refrigerant (see the chain line arrow in FIG. 2). This operation allows a total amount of refrigerant (hot gas) to be supplied to the outdoor heat exchanger 4 to heat it rapidly.

At the subsequent step ST11, the process determines whether the temperature of the outdoor heat exchanger 4 has reached the defrost cancel temperature value (+10° C.), and if so, transfers to step ST9 to cancel reverse defrosting. That is, the four-way valve 2 is switched to the original heating operation side to enter the normal heating operation mode.

This operation enables defrosting to be executed in a short time even if the heat exchanger is heavily frosted. Besides, since hot gas bypass defrosting has increased the heat exchanger temperature to a certain value, reverse defrosting does not require a large amount of time, thereby precluding the room temperature from decreasing, that is, preventing the indoor environment from being degraded.

During defrosting using the hot gas bypass defrosting method, it is preferable to reduce the degree of the opening of the electronic expansion valve 5 and thus the amount of refrigerant flowing from the indoor heat exchanger 3 to the outdoor heat exchanger 4 in order to relatively increase the amount of refrigerant flowing through the bypass pipe 7.

This function enables the outdoor heat exchanger 4 to be effectively defrosted using the hot gas bypass defrosting method and reduces the defrosting time required by the subsequent reverse defrosting method. When the process switches to the reverse defrosting method, the electronic expansion valve 5, which has been contracted, is returned to its original state.

According to this embodiment, after the hot gas bypass defrostingmethod has been switched to the reverse defrosting method at step ST6, the latter method is continued until the temperature reaches the defrost cancel temperature value. When, however, the temperature of the outdoor heat exchanger 4 has been increased up to a certain value using the reverse defrosting method and the temperature change rate ΔTn reaches a predetermined value or higher, the process may switch to the hot gas bypass defrosting method again. To achieve this, step ST11 may be omitted so that the process transfers from step ST10 to step ST8.

That is, if the reverse defrosting method increases the speed of defrosting to increase the temperature of the outdoor heat exchanger 4 up to a certain value, then a sufficient defrosting capability will be provided even if the process subsequently switches to the hot gas bypass defrosting method. The switching from the reverse defrosting method to the hot gas bypass defrosting method reduces the time during which the indoor machine must be stopped, thereby further preventing the room temperature from decreasing.

In addition, an ordinary air conditioner includes a suction sensor section 15 used for another control, and during a heating operation, the suction sensor section 15 is located close to the refrigerant runoff port of the outdoor heat exchanger 4. Accordingly, this suction sensor section 15 may substitute for the temperature sensor 14 on the refrigerant runoff port side of the outdoor heat exchanger 4. This configuration allows one of the temperature sensors to be omitted so it is economically preferable.

Although this invention has been described in detail with reference to the specific embodiment, changes, modifications, and equivalents to this invention can be easily conceived by those skilled in the art when understanding the above contents. Thus, the scope of this invention should be defined by the accompanying claims and their equivalents.

I claim:

1. A method for controlling an air conditioner comprising:

a refrigerating cycle including a compressor, four-way valve, an indoor heat exchanger, an expansion valve, and an outdoor heat exchanger to switch said four-way valve to reversibly switch the refrigerating cycle between a heating and a cooling operation modes;

a hot gas bypass passage connecting together a refrigerant ejection port of said compressor and a refrigerant inflow port of said outdoor heat exchanger, and a shut-off valve provided in the hot gas bypass; and temperature sensors that detect the temperatures of the refrigerant inflow and runoff port sides of said outdoor heat exchanger, wherein:

when, in said heating operation mode, the temperature of the refrigerant inflow or runoff port side of said outdoor heat exchanger reaches a predetermined value or lower that requires defrosting, said shut-off valve is "opened" to start defrosting using the hot gas bypass defrosting method, and wherein the temperature of the refrigerant runoff port side of said outdoor heat exchanger is detected every specified time so that if the temperature change rate is less than or equal to a predetermined value, said shut-off valve is "closed" and said four-way valve is switched to said cooling operation mode side in order to switch to the reverse defrosting method that allows a hot gas to flow in the reverse direction from said compressor to said outdoor heat exchanger.

2. A method for controlling an air conditioner according to claim 1 wherein during defrosting using said hot gas bypass defrosting method, said expansion valve is contracted in a predetermined manner to reduce the amount of refrigerant passing through the valve, whereas during defrosting using said reverse defrosting method, said expansion valve is returned to the state existing during said heating operation mode.

3. A method for controlling an air conditioner according to claim 1 wherein if during defrosting using said reverse defrosting method, said temperature change rate reaches a predetermined value or higher, said shut-off valve is "opened" and said four-way valve is switched to said heating operation mode to return to said hot gas bypass defrosting method.

4. An air conditioner comprising:

a refrigerating cycle including a compressor, four-way valve, an indoor heat exchanger, an expansion valve, and an outdoor heat exchanger to switch said four-way valve to reversibly switch the refrigerating cycle between a heating and a cooling operation modes;

a hot gas bypass passage connecting together a refrigerant ejection port of said compressor and a refrigerant inflow port of said outdoor heat exchanger, and a shut-off valve provided in the hot gas bypass;

a first temperature sensor provided on the refrigerant inflow port side of said outdoor heat exchanger and a second temperature sensor provided on the refrigerant runoff port side of said outdoor heat exchanger; and a control means for controlling a defrosting mode based on temperature signals from each temperature sensor, wherein:

in said heating operation mode, when the temperature of said refrigerant inflow port side reaches a predetermined value or lower that requires defrosting, said control means "opens" said shut-off valve to start defrosting using the hot gas bypass defrosting method, and wherein said control means detects the temperature of the refrigerant runoff port side of said outdoor heat exchanger every specified time and if the temperature change rate is less than or equal to a predetermined value, "closes" said shut-off valve while switching said four-way valve to said cooling operation mode side in order to switch to the reverse defrosting method that allows a hot gas to flow in the reverse direction from said compressor to said outdoor heat exchanger.

5. An air conditioner according to claim 4 wherein said refrigerating cycle further has a suction sensor section, said control means uses a temperature signal from said suction sensor section instead of the temperature signal from said second temperature sensor to control said defrosting mode.

* * * * *